US012048334B2

(12) United States Patent
Chan et al.

(10) Patent No.: US 12,048,334 B2
(45) Date of Patent: Jul. 30, 2024

(54) FRAME FOR AN AEROSOL-GENERATING DEVICE AND METHOD OF FORMING A FRAME

(71) Applicant: Philip Morris Products S.A., Neuchatel (CH)

(72) Inventors: Teck Yan Chan, Singapore (SG); Takaaki Hirayama, Yamato (JP); Makoto Shinyama, Yamato (JP)

(73) Assignee: Philip Morris Products S.A., Neuchatel (CH)

( * ) Notice: Subject to any disclaimer, the term of this patent is extended or adjusted under 35 U.S.C. 154(b) by 363 days.

(21) Appl. No.: 17/616,357

(22) PCT Filed: Jun. 2, 2020

(86) PCT No.: PCT/EP2020/065236
§ 371 (c)(1),
(2) Date: Dec. 3, 2021

(87) PCT Pub. No.: WO2020/245127
PCT Pub. Date: Dec. 10, 2020

(65) Prior Publication Data

US 2022/0322751 A1 Oct. 13, 2022

(30) Foreign Application Priority Data

Jun. 5, 2019 (EP) ..... 19178518

(51) Int. Cl.
*A24F 40/90* (2020.01)
*A24F 40/20* (2020.01)
(Continued)

(52) U.S. Cl.
CPC ..... *A24F 40/90* (2020.01); *A24F 40/20* (2020.01); *A24F 40/70* (2020.01)

(58) Field of Classification Search
None
See application file for complete search history.

(56) References Cited

U.S. PATENT DOCUMENTS

2017/0094998 A1 4/2017 Bernauer et al.
2018/0070636 A1 3/2018 Ruscio et al.
(Continued)

FOREIGN PATENT DOCUMENTS

CN 106413445 A 2/2017
CN 107087818 A 8/2017
(Continued)

OTHER PUBLICATIONS

CN208228308U English translation obtained from Espacenet Mar. 21, 2024 (Year: 2024).*
(Continued)

*Primary Examiner* — Philip Y Louie
*Assistant Examiner* — Eric M Fierce
(74) *Attorney, Agent, or Firm* — Oblon, McClelland, Maier & Neustadt, L.L.P.

(57) ABSTRACT

A frame for an aerosol-generating device is provided, the frame including: a base frame formed from an electrically conductive material; an electrical connector having a plurality of electrical contacts arranged on a connector frame formed from an electrically insulating material, the electrical connector being secured to the base frame such that the base frame is electrically connected to at least one of the electrical contacts of the electrical connector; and a support frame formed from an electrically insulating material, in which the base frame and electrical connector are at least partially embedded in the support frame. A method of manufacturing a frame for an aerosol-generating device, and an aerosol-generating device including a frame, are also provided.

13 Claims, 6 Drawing Sheets

(51) Int. Cl.
*A24F 40/40* (2020.01)
*A24F 40/70* (2020.01)

(56) References Cited

U.S. PATENT DOCUMENTS

| | | | | |
|---|---|---|---|---|
| 2018/0271151 | A1* | 9/2018 | Litten | A24F 40/485 |
| 2019/0000146 | A1 | 1/2019 | Lin et al. | |
| 2020/0046031 | A1 | 2/2020 | Bernauer et al. | |

FOREIGN PATENT DOCUMENTS

| | | | | |
|---|---|---|---|---|
| CN | 108024576 | A | 5/2018 | |
| CN | 109068754 | A | 12/2018 | |
| CN | 208228308 | U * | 12/2018 | A24F 47/00 |
| JP | 2016-512681 | A | 5/2016 | |
| JP | 6218803 | B2 | 10/2017 | |
| JP | 2018-512129 | A | 5/2018 | |
| KR | 10-2015-0030732 | A | 3/2015 | |
| RU | 2 656 090 | C2 | 5/2018 | |
| RU | 2 656 823 | C2 | 6/2018 | |
| WO | WO 2015/139985 | A1 | 9/2015 | |
| WO | WO 2016/150979 | A1 | 9/2016 | |
| WO | WO 2018/202730 | A1 | 11/2018 | |
| WO | WO 2020/229465 | A1 | 11/2020 | |

OTHER PUBLICATIONS

International Search Report and Written Opinion issued on Sep. 15, 2020 in PCT/EP2020/065236 filed Jun. 2, 2020, 8 pages.
Combined Russian Office Action and Search Report issued Oct. 6, 2023 in Russian Patent Application No. 2021137265/03 (with English Translation), 14 pages.
Chinese Office Action and Search Report mailed on Jan. 13, 2024, issued in Chinese Patent Application No. 202080035442.3 filed on Jun. 2, 2020, with English Translation, total 14 pages (citing documents 15-17, therein).
Japanese Office Action mailed on May 30, 2024, issued in Japanese Patent Application No. 2021-571376, with English Translation, total 5 pages (citing documents 15-17, therein).

* cited by examiner

FRAME FOR AN AEROSOL-GENERATING DEVICE AND METHOD OF FORMING A FRAME

The present disclosure relates to a frame for an aerosol-generating device. The present disclosure also relates to a method of forming a frame for an aerosol-generating device. The present disclosure also relates to an aerosol-generating device comprising a frame.

Aerosol-generating systems in which an aerosol-forming substrate, such as a tobacco containing substrate, is heated rather than combusted are known in the art. The aim of such aerosol-generating systems is to reduce known harmful smoke constituents produced by the combustion and pyrolytic degradation of tobacco in conventional cigarettes. Typically in such aerosol-generating systems, an aerosol is generated by the transfer of energy from an aerosol generator of an aerosol-generating device to an aerosol-forming substrate or material in an aerosol-generating article that is physically separate to the aerosol-generating device. For example, the aerosol generator may be an electric heater and an aerosol may be generated by the transfer of heat from the electric heater to an aerosol-forming substrate. The aerosol-generating article may be located within, around or downstream of the heater. During use, volatile compounds are released from the aerosol-forming substrate by heat transfer from the heater to the aerosol-forming substrate and entrained in air drawn through the aerosol-generating article. As the released compounds cool, they condense to form an aerosol that may be inhaled by a consumer.

The components of an aerosol-generating device are typically housed within a housing of approximately equivalent diameter to a conventional smoking article, such as a lit end cigarette or cigar, which can be challenging. The limited dimensions of the aerosol-generating device also increase the difficulty of providing suitable electrical connections between the various components, and increase the difficulty of manufacturing the devices at relatively high volumes.

It would be desirable to provide an electrically operated aerosol generating device that facilitates manufacture of the device. It would be desirable to provide an electrically operated aerosol generating device having a compact and robust frame. It would also be desirable to provide improved methods and apparatuses for providing electrical connections between the various system components of aerosol generating systems.

According to this disclosure, there is provided a frame for an aerosol-generating device. The frame may comprise a base frame formed from an electrically conductive material. The frame may comprise an electrical connector having an electrical contact. The electrical connector may be secured to the base frame such that the base frame is electrically connected to the electrical contact of the electrical connector. The frame may comprise a support frame formed from an electrically insulating material, the base frame and electrical connector being at least partially embedded in the support frame.

In particular, according to this disclosure there is provided a frame for an aerosol-generating device. The frame comprises: a base frame formed from an electrically conductive material; an electrical connector having an electrical contact, the electrical connector being secured to the base frame such that the base frame is electrically connected to the electrical contact of the electrical connector; and a support frame formed from an electrically insulating material, the base frame and electrical connector being at least partially embedded in the support frame.

Advantageously, providing such a frame for an aerosol-generating device may enable the size and complexity of the aerosol-generating device to be reduced in comparison to aerosol-generating devices having other frames. The size and complexity of the aerosol-generating device may be reduced due to the base frame and electrical connector being at least partially embedded in the same support frame, as described in more detail below.

According to this disclosure, there is also provided a method of manufacturing a frame for an aerosol-generating device. The method may comprise providing a base frame formed from an electrically conductive material. The method may comprise providing an electrical connector having an electrical contact. The method may comprise securing the base frame to the electrical connector, such that the base frame is electrically connected to the electrical contact of the electrical connector. The method may comprise at least partially embedding the base frame and the electrical connector in a support frame formed from an electrically insulating material.

In particular, according to this disclosure there is provided a method of manufacturing a frame for an aerosol-generating device. The method comprises: providing a base frame formed from an electrically conductive material; providing an electrical connector having an electrical contact; securing the base frame to the electrical connector, such that the base frame is electrically connected to the electrical contact of the electrical connector; and at least partially embedding the base frame and the electrical connector in a support frame formed from an electrically insulating material.

There may also be provided a frame for an aerosol-generating device, the frame being manufactured by the method described above.

Advantageously, providing such a frame for an aerosol-generating device reduces the complexity of the manufacturing process. The reduction in complexity of the manufacturing process is due to the base frame and electrical connector being initially electrically and structurally coupled together before being further structurally coupled together by being at least partially embedded in the support frame. Such a manufacturing process may also be more straightforward to automate than other manufacturing processes.

As used herein, the term "aerosol-generating device" refers to a device that interacts with an aerosol-forming substrate to generate an aerosol.

As used herein, the term "aerosol-forming substrate" relates to a substrate capable of releasing volatile compounds that can form an aerosol. Such volatile compounds may be released by heating the aerosol-forming substrate. An aerosol-forming substrate is typically part of an aerosol-generating article.

As used herein, the term "aerosol-generating article" refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick.

As used herein, the term "aerosol-generating system" refers to the combination of an aerosol-generating device with an aerosol-generating article. In the aerosol-generating system, the aerosol-generating article and the aerosol-generating device cooperate to generate a respirable aerosol.

Some known aerosol-generating devices comprise frames having a sub-frame of electrically conductive material embedded in a supporting frame of electrically insulating material. The supporting frames of such frames typically comprise a coupling portion that is specifically shaped to couple with an electrical connector. A portion of an electrical connector may also be configured to couple with the coupling portion of the supporting frame, such as by a press fit, snap fit or screw fit, and once the supporting frame and electrical connector are coupled together, the base frame and one or more electrical contacts of the electrical connector are electrically connected together and secured in place by soldering or welding. The inventors have realised that it is possible to reduce the complexity of manufacture of such frames, and to reduce the size of such frames. This is, in part, due to the known supporting frames and electrical connectors having portions that are configured to couple together. The inventors have realised that embedding a base frame and an electrical connector in a single support frame may negate the need for coupling structures to be provided in each of the base frame and electrical connector, and result in a frame that is smaller in size than other such known frames, while also retaining all the same capacity as the known frames. Furthermore, embedding a base frame and an electrical connector in a single support frame may reduce the number of steps required to manufacture the frame, and reduce the amount of material required to manufacture the frame.

Advantageously, at least partially embedding both the base frame and electrical connector in the support frame also provides a robust structural connection between the base frame and the electrical connector.

The base frame is formed from an electrically conductive material. As used herein, "electrically conductive" refers to materials having an electrical resistivity of $1\times10^{-4}$ ohm metres (Ωm), or less, at twenty degrees Celsius. The base frame is formed from an electrically conductive material so that electrical components of the aerosol-generating device may be electrically connected to the base frame. The base frame may be formed from any suitable electrically conductive material.

The electrical contact of the electrical connector is also formed from an electrically conductive material. The electrical contact of the electrical connector is electrically connected to the base frame. The electrical contact of the electrical connector may be formed from any suitable electrically conductive material.

In some embodiments, the base frame and the electrical contact of the electrical connector are formed from the same electrically conductive material. In some embodiments, the base frame and the electrical contact of the electrical connector are formed from different electrically conductive materials.

Suitable electrically conductive materials may comprise a metal. The base frame may be metallic. The electrical contact of the electrical connector may be metallic. Suitable metals include aluminium, copper, iron, gold, zinc or any suitable alloy of such metals. Suitable alloys include some stainless steels and some copper alloys, such as brass, copper and nickel alloys, copper beryllium alloys, and phosphor bronze.

Preferably, the base frame is formed from brass. Utilising brass to manufacture the base frame may be advantageous because it is suitably malleable to allow the base frame to be folded into the required shape, and can be soldered to enable electrical components of an aerosol-generating device to be connected to the base frame. The use of brass may enable a suitable electrical resistance to be provided between the components of the aerosol generating device. In addition, brass may be suitably resilient to retain components of the aerosol-generating device, such as the power supply.

The electrically conductive material of the base frame may have a thickness of between about 0.05 mm to about 1.0 mm, and may preferably have a thickness of about 0.2 mm. It will apparent to one of ordinary skill in the art that other appropriate thicknesses can be determined based on bending resistance of the material used, and the required support to be provided by the base frame to other components of the device.

In some embodiments, the electrical contact of the electrical connector is formed from a magnetic material. As used herein, the term "magnetic material" refers to a material which is able to interact with a magnetic field, including both paramagnetic and ferromagnetic materials. A magnetisable material may be a paramagnetic material, such that it only remains magnetised in the presence of an external magnetic field. Alternatively, a magnetisable material may be a material which becomes magnetised in the presence of an external magnetic field and which remains magnetised after the external field is removed (a ferromagnetic material, for example). The term "magnetic material" as used herein encompasses both types of magnetisable material, as well as material which is already magnetised.

Suitable magnetic materials include alloys of neodymium, such as neodymium, iron and boron. In other words, the magnetic material may be a neodymium magnet. Suitable magnetic materials also include ferromagnetic stainless steels, such as SS430 stainless steel.

The base frame is secured to the electrical connector. In some embodiments, the base frame may be releasably secured to the electrical connector. Preferably, the base frame is fixedly secured to the electrical connector. As used herein, the term "fixedly secured" refers to a permanent attachment of two components, such that releasing the attachment between the components is not possible without damaging or destroying the "fixedly secured" components.

The base frame may be secured to the electrical connector in any suitable manner.

In some embodiments, the base frame is secured to the electrical connector by the support frame. In some embodiments, the base frame is fixedly secured to the electrical connector by the support frame. The support frame may be moulded over at least a portion of the base frame and at least a portion of the electrical connector to fixedly secure the base frame to the electrical connector.

In some preferred embodiments, the base frame is secured to the electrical connector by soldering or welding. Preferably, the base frame is secured to the electrical connector by laser welding. Laser welding the base frame to the electrical connector fixedly secures the base frame to the electrical connector. Particularly preferably, the base frame is laser welded to the electrical contact of the electrical connector.

The base frame may be secured to the electrical connector at a single location. The base frame may be secured to the electrical connector at a plurality of locations.

Preferably, the base frame is secured to the electrical connector at the electrical contact. This may ensure a robust electrical connection between the base frame and the electrical contact of the electrical connector. The base frame may be secured to the electrical contact by welding. Particularly preferably, the base frame is secured to the electrical contact by laser welding.

The base frame may be secured to the electrical contact at a single location. The base frame may be secured to the electrical contact at a plurality of locations.

The base frame may be secured to the electrical connector at any suitable time during the manufacturing process. For example, the base frame may be secured to the electrical connector when the base frame and the electrical connector are at least partially embedded in the support frame. However, preferably, the base frame is secured to the electrical connector before the base frame and the electrical connector are at least partially embedded in the support frame. Particularly preferably, the electrical contact of the electrical connector is laser welded to the base frame before the base frame and the electrical connector are at least partially embedded in the support frame.

The base frame is electrically connected to the electrical contact of the electrical connector. As used herein, the terms "electrically connected" and "electrical connection" refer to a connection by means of an electrically conductive path.

The base frame may be electrically connected to the electrical contact at a single location. The base frame may be electrically connected to the electrical contact at a plurality of locations.

The support frame is formed from an electrically insulating material. As used herein, "electrically insulating" refers to materials having an electrical resistivity of $1\times10^4$ ohm metres (Ωm), or more, at twenty degrees Celsius.

The support frame may be formed from any suitable electrically insulating material. Preferably, the support frame is formed from a material that is suitable for moulding over the base frame and electrical connector. The support frame may be formed from a polymer material. In particular, the support frame may be formed from a mouldable polymer. Preferably, the support frame is formed from a material that is suitable for use in a moulding process, such as injection moulding. Particularly suitable polymer materials include thermoplastics materials and thermosetting polymers. Suitable polymer materials include: polyphthalamide (PPA), polycarbonate (PC), a blend of polycarbonate and acrylonitrile butadiene styrene (PC-ABS), polyphenylsulfone (PPSU), Polyetheretherketone (PEEK), polypropylene (PP), polyethylene (PE), polyimide (PI), thermoplastic polyimide (TPI), polyamidimide (PAI), and polyetherimide (PEI). The polymer material may be a composite. The composite polymer material may comprise other martials, such as fibrous filler materials, including one or more of carbon fibres and glass fibres. Preferably, the material is light and non-brittle.

The base frame and the electrical connector are at least partially embedded in the support frame. As used herein, the term "embedded" refers to a component that is surrounded by, and secured within another component. In other words, at least a portion of the base frame is surrounded by, and secured within the support frame. In other words, at least a portion of the electrical connector is surrounded by, and secured within the support frame.

The base frame and electrical connector may be at least partially embedded in the support frame in any suitable manner. The support frame may be formed by a moulding process, such as injection moulding. Preferably, at least a portion of the base frame and electrical connector are overmoulded by electrically insulating material which forms the support frame. In some preferred embodiments, the support frame is formed by overmoulding the electrically insulating material over the base frame and the electrical connector to at least partially embed the base frame and the electrical connector in the support frame.

The electrical connector may be any type of electrical connector suitable for electrical connection with a complementary electrical connector, particularly a complementary electrical connector of an external device. The electrical connector may be configured for the transfer of electrical power between one or more components of an aerosol-generating device including the frame, and an external power supply. The electrical connector may be configured for the transfer of data between one or more components of an aerosol-generating device including the frame and an external device.

In some preferred embodiments, the electrical connector comprises a connector frame. The connector frame may support the electrical contact of the electrical connector.

Preferably, the connector frame is formed from an electrically insulating material. The connector frame may be formed from any suitable electrically insulating material. Preferably, the connector frame is formed from a material that is suitable for use in a moulding process, such as injection moulding. The connector frame may be formed from a polymer material. In particular, the connector frame may be formed from a mouldable polymer. Particularly suitable polymer materials include thermoplastics materials and thermosetting polymers. Suitable polymer materials include: polyphthalamide (PPA), polycarbonate (PC), a blend of polycarbonate and acrylonitrile butadiene styrene (PC-ABS), polyphenylsulfone (PPSU), Polyetheretherketone (PEEK), polypropylene (PP), polyethylene (PE), polyimide (PI), thermoplastic polyimide (TPI), polyamidimide (PAI), and polyetherimide (PEI). The polymer material may be a composite. The composite polymer material may comprise other martials, such as fibrous filler materials, including one or more of carbon fibres and glass fibres. Preferably, the material is light and non-brittle.

The electrical contact of the electrical connector may be any suitable shape and size. For example, the electrical contact may be substantially circular or polygonal, such as triangular, square, pentagonal or hexagonal. The electrical contact may be substantially annular. In other words, the electrical contact may have the form of a ring or a coil. The electrical contact may have the form of a pin. The electrical contact may be a resilient contact that is actuable between an extended position and a depressed position. The electrical contact may be a resilient pin contact that is actuable between an extended position and a depressed position.

The electrical contact of the electrical connector may be at least partially embedded in the connector frame. The electrical contact of the electrical connector may be partially embedded in the connector frame such that a portion of the electrical contact is exposed. An exposed portion of the electrical contact of the electrical connector may be arranged to contact a complementary electrical contact of a complementary electrical connector of an external device.

In some embodiments, the electrical contact of the electrical connector may be fully embedded within the connector frame. In these embodiments, the electrical contact of the electrical connector may be configured to electrically connect to a complementary electrical contact of a complementary electrical connector by inductive coupling or capacitive coupling. In particular, the electrical connector may be configured to electrically connect to a complementary electrical contact of a complementary electrical connector by induction. Accordingly, such an electrical contact fully embedded in a connector frame may be provided in the form of an inductor coil.

The electrical contact may be at least partially embedded in the connector frame in any suitable manner. The connector frame may be formed by a moulding process, such as injection moulding. Preferably, at least a portion of the electrical contact is overmoulded by electrically insulating material which forms the connector frame. In some preferred embodiments, the connector frame is formed by overmoulding the electrically insulating material over the electrical contact to at least partially embed the base frame and the electrical connector in the support frame.

The electrical connector comprises an electrical contact formed from electrically conductive material. In some preferred embodiments, the electrical connector comprises a plurality of electrical contacts. The electrical connector may comprise any suitable number of electrical contacts. For example, the electrical connector may comprise one, two, three, four, five, six, seven, eight, nine or ten electrical contacts.

The plurality of electrical contacts may be arranged on a connector frame formed from an electrically insulating material. The plurality of electrical contacts may be arranged on a connector frame in any suitable arrangement.

In some preferred embodiments, the electrical connector comprises a plurality of electrical contacts, the plurality of electrical contacts being arranged on a connector frame formed from an electrically insulating material.

Where the electrical connector comprises a plurality of electrical contacts, each electrical contact may be electrically isolated from the other electrical contacts. Where the electrical connector comprises a connector frame formed from an electrically insulating material, the connector frame may be configured to support the plurality of electrical contacts such that each electrical contact is electrically isolated from the other electrical contacts.

One or more of the electrical contacts of the electrical connector may be at least partially embedded in the connector frame. One or more electrical contacts of the electrical connector may be fully embedded within the connector frame.

In some preferred methods of manufacturing a frame, the step of providing the electrical connector may comprise: providing a plurality of electrical contacts; and at least partially embedding one or more of the electrical contacts in a connector frame formed from an electrically insulating material to form the electrical connector.

One or more of the plurality of electrical contacts may be at least partially embedded in the connector frame in any suitable manner. The connector frame may be formed by a moulding process, such as injection moulding. Preferably, at least a portion each of the one or more electrical contacts to be at least partially embedded in the connector frame is overmoulded by electrically insulating material which forms the connector frame. In some preferred embodiments, one or more of the electrical contacts is provided or arranged on the connector frame after the connector frame has been formed. In some embodiments, all of the electrical contacts are provided on the connector frame after the connector frame has been formed. In some embodiments, the electrical connector comprises one or more electrical contacts at least partially embedded in the connector frame and one or more electrical contacts supported on the connector frame. In these embodiments, the one or more electrical contacts supported on the connector frame are not embedded in the connector frame.

In embodiments including an electrical connector comprising a plurality of electrical contacts, the base frame is electrically connected to at least one of the electrical contacts. The base frame may be electrically connected to a plurality of the electrical contacts. The base frame may be electrically connected to each of the electrical contacts. The base frame may also be secured to the electrical connector at least at one of the electrical contacts. The base frame may be secured to a plurality of the electrical contacts. The base frame may be secured to each of the electrical contacts.

Advantageously, providing the electrical connector with a plurality of electrical contacts enables the electrical connector to be configured for a plurality of purposes. In some preferred embodiments having an electrical connector comprising a plurality of electrical contacts, one or more electrical contacts of the electrical connector is configured for the transfer of power between an aerosol-generating device comprising the frame and an external power supply, and one or more electrical contacts of the electrical connector is configured for the transfer of data between an aerosol-generating device comprising the frame and an external device.

In some preferred embodiments, the electrical connector comprises at least three electrical contacts. A second one of the electrical contacts may at least partially circumscribe a first one of the electrical contacts. A third one of the electrical contacts may at least partially circumscribe the first one of the electrical contacts. In some embodiments, the first electrical contact of the electrical connector may be substantially circular. In some embodiments, the second and third electrical contacts of the electrical connector are substantially annular. In some particularly preferred embodiments, each one of the second and third electrical contacts forms a ring which substantially circumscribes the first electrical contact. The second and third electrical contacts of the electrical connector may form concentric rings circumscribing the first electrical contact.

In some particularly preferred embodiments, the electrical connector comprises a face and a recess arranged substantially centrally in the face, the recess having a closed end, an open end at the face and a sidewall extending between the open end and the closed end. The first electrical contact may be arranged at the closed end of the recess. The second electrical contact may be arranged at the sidewall of the recess and substantially circumscribe the first electrical contact. The third electrical contact may be arranged at the face and substantially circumscribe the first electrical contact.

The electrical connector may comprise a magnetic element. A magnetic element is an element formed from a magnetic material. Advantageously, providing the electrical connector with a magnetic element may enable the electrical connector to be magnetically attracted to a complementary electrical connector, and such a magnetic attraction may provide a more robust electrical connection between the electrical connector and the complementary electrical connector. The electrical connector may comprise any suitable number of magnetic elements. The electrical connector may comprise a plurality of magnetic elements. A magnetic element of the electrical connector may be at least partially embedded in the connector frame. A magnetic element of the electrical connector may be entirely embedded in the connector frame. In some embodiments, an electrical contact of the electrical connector comprises a magnetic element. In other words, an electrical contact of the electrical connector may be formed from a magnetic material.

The base frame may take any suitable form. Typically, the base frame is elongate. In other words, the base frame may have a length that is greater than the other dimension of the base frame, such as the width and thickness.

As used herein, the term "length" refers to the major dimension in a longitudinal direction of a frame for an aerosol-generating device, an aerosol-generating device, or a component of the aerosol-generating device.

As used herein, the term "width" refers to the major dimension in a transverse direction of a frame for an aerosol-generating device, an aerosol-generating device, or a component of the aerosol-generating device, at a particular location along its length. The term "thickness" refers to the dimension in a transverse direction perpendicular to the width.

As used herein, the term "transverse cross-section" is used to describe the cross-section of a frame for an aerosol-generating device, an aerosol-generating device, or a component of the aerosol-generating device, in a direction perpendicular to the longitudinal direction at a particular location along its length.

The base frame may have a proximal end and a distal end. As used herein, the term "proximal" refers to a user end, or mouth end of the aerosol-generating device. The proximal end of the base frame is the end of the base frame closest to the user end, or mouth end of an aerosol-generating device comprising the frame. As used herein, the term "distal" refers to the end opposite the proximal end. The electrical connector is typically arranged at the distal end of the frame. The electrical connector may be arranged at the distal end of an aerosol-generating device comprising the frame.

In some preferred embodiments, the base frame is elongate, having a proximal end and a distal end opposite the proximal end, and the electrical connector is secured to the base frame at the distal end.

The base frame is formed from electrically conductive material. As such, the base frame may be used to electrically connect components of the aerosol-generating device. In particular, the base frame is electrically connected to the electrical contact of the electrical connector, and the base frame may be used to electrically connect one or more electrical components of the aerosol-generating device to one or more electrical contacts of the electrical connector.

Preferably, at least a portion of the base frame forms a ground plane. As used herein, the term ground plane refers to an electrically conductive surface that appears as an infinite ground potential to components of the electrically operated aerosol-generating device.

A ground plane portion of the base frame may have any suitable shape and configuration. For example, a ground plane portion of the base frame may be elongate. A ground plane portion of the base frame may have a rectangular transverse cross-section.

A ground plane portion of the base frame may have a proximal end and a distal end. The distal end of a ground plane portion of the base frame may be electrically connected to an electrical contact of the electrical connector. The distal end of a ground plane portion of the base frame may be secured to an electrical contact of the electrical connector, such as by laser welding. The proximal end of a ground plane portion of the base frame may be configured to be electrically connected to an electrical component of an aerosol-generating device comprising the frame.

A ground plane portion of the base frame may be electrically connected to a negative terminal of an electrical power supply of an aerosol-generating device comprising the frame. An electronic circuit board of the aerosol-generating device may be electrically connected to the ground plane.

In some embodiments, the entire base frame may form a ground plane.

Preferably, at least a portion of the base frame forms an electrical track. An electrical track may be configured for the transfer of electrical power between a component of an aerosol-generating device comprising the frame and an electrical contact of the electrical connector. An electrical track may be configured for the transfer of data, in the form of an electrical signal, between a component of an aerosol-generating device comprising the frame and an electrical contact of the electrical connector. An electrical track may have any suitable shape and configuration. For example, an electrical track may be elongate. An electrical track may have a rectangular transverse cross-section.

An electrical track may have a proximal end and a distal end. The distal end of an electrical track may be electrically connected to an electrical contact of the electrical connector. The distal end of an electrical track may be secured to an electrical contact of the electrical connector, such as by laser welding. The proximal end of an electrical track may be configured to be electrically connected to an electrical component of an aerosol-generating device comprising the frame.

In some embodiments, a portion of the base frame may comprise a ground plane and a portion of the base frame may comprise an electrical track. Where the base frame comprises a ground plane and an electrical track, the ground plane and the electrical track may be electrically insulated from each other. A ground plane portion and an electrical track may be spaced apart such that the ground plane portion is electrically isolated from the electrical track. Advantageously, by at least partially embedding the base frame in the support frame, the support frame may maintain a separation between the ground plane and the electrical track to electrically insulate the ground plane from the electrical track. A ground plane portion and an electrical track may be formed from separate pieces of electrically conductive material. A ground plane portion and an electrical track may be formed from a single piece of electrically conductive material, and separated during forming of the base frame. Where a ground plane portion and an electrical track are formed from a single piece of electrically conductive material, and separated during forming of the base frame, such separation may be achieved by punching a cavity between the ground plane portion and electrical track.

In embodiments in which the base frame comprises a ground plane portion and an electrical track, the ground plane portion and the electrical track may be formed of the same electrically conductive material. In some embodiments, the ground plane portion and the electrical track are formed from different materials. In some embodiments, the ground plane portion are formed from brass, and the electrical track may be formed from phosphor bronze.

An electrical track may be used to electrically connect components of the aerosol-generating device. For example, an electrical track may be used to electrically connect an electronic circuit board of the aerosol-generating device to an electrical contact of the electrical connector.

In some embodiments, the base frame may comprise a plurality of electrical tracks. Each electrical track may be electrically isolated from the other electrical tracks. Each electrical track may be at least partially embedded in the support frame and the support frame may maintain a separation between the electrical tracks to electrically isolate each electrical track from the other electrical tracks.

The base frame may be substantially rigid. Advantageously, providing a substantially rigid base frame may simplify the manufacturing process compared to using electrically conductive wires. The ground plane may be substantially rigid. The one or more electrical tracks may be substantially rigid.

In some preferred embodiments, the base frame comprises a ground plane portion and two electrical tracks. In some particularly preferred embodiments, the base frame comprises two ground plane portions and two electrical tracks. In these particularly preferred embodiments, the two electrical tracks may be arranged between the two ground plane portions.

In some preferred embodiments, an electrical contact of the electrical connector is configured for the transfer of electrical power between an aerosol-generating device comprising the frame and an external device. In other words, the electrical connector may comprise an electrical power contact. In some of these preferred embodiments, the base frame comprises an electrical track electrically connected to an electrical power contact of the electrical connector. An electrical track electrically connected to an electrical power contact of the electrical connector may be referred to as a power track. A power track may be arranged to electrically connect an electrical power contact of the electrical connector to one or more electrical components of an aerosol-generating device comprising the frame. A power track may be electrically insulated from a ground plane portion of the base frame and other electrical tracks of the base frame. A power track may be electrically insulated from a ground plane and other tracks of the base frame by the support frame.

In some preferred embodiments, an electrical contact of the electrical connector is configured for the transfer of data between an aerosol-generating device comprising the frame and an external device. In other words, the electrical connector may comprise an electrical data contact. In some of these preferred embodiments, the base frame comprises an electrical track electrically connected to an electrical data contact of the electrical connector. An electrical track electrically connected to an electrical data contact of the electrical connector may be referred to as a data track. A data track may be arranged to electrically connect an electrical data contact of the electrical connector to one or more electrical components of an aerosol-generating device comprising the frame. A data track may be electrically insulated from a ground plane portion of the base frame and other electrical tracks of the base frame. A data track may be electrically insulated from a ground plane and other tracks of the base frame by the support frame.

The electrical connector may comprise a plurality of electrical data contacts and the base frame may comprise a plurality of data tracks, each data track being configured to electrically connect an electrical data contact to a component of an aerosol-generating device comprising the frame. Each electrical data contact of the electrical connector may be electrically insulated from the other electrical data contacts of the electrical connector. Each data track of the base frame may be electrically insulated from the other data tracks of the base frame.

The width of a data track may be less than the width of a power track.

A ground plane portion of the base frame may comprise one or more pins configured to be electrically coupled to a component of an aerosol-generating device comprising the frame. In particular, a proximal end of a ground plane portion of the base frame may comprise one or more pins.

An electrical track of the base frame may comprise one or more pins configured to be electrically coupled to a component of an aerosol-generating device comprising the frame. In particular, a proximal end of an electrical track of the base frame may comprise one or more pins.

A pin may be configured to be received in a corresponding hole in an electronic circuit board of an aerosol-generating device comprising the frame.

A pin may be formed integrally with a ground plane portion or an electrical track. A pin may be a physically separate component to a ground plane portion or an electrical track. A pin may be secured to a ground plane portion or an electrical track, such as by laser welding. A pin is formed from an electrically conductive material. A pin may be formed from the same electrically conductive material as a ground plane portion or an electrical track. A pin may be formed from a different electrically conductive material to a ground plane portion or an electrical track.

In some embodiments, the base frame is formed from a plurality of pieces of electrically conductive material. In these embodiments, one or more of the pieces may form a ground plane. In these embodiments, one of the pieces may form an electrical track. In these embodiments, a plurality of the pieces may form a ground plane and a plurality of the pieces may form a plurality of electrical tracks.

The base frame is preferably manufactured from a single laminar sheet of electrically conductive material. Preferably, the material is brass. Advantageously, brass may be suitably malleable to be folded into the required shape. The base frame may be formed into shape by any suitable method. For example, the base frame may be pressed into shape. For example, the base frame may be stamped into shape. For example, the base frame may be cut into shape. For example, the base frame may be formed into shape. In some embodiments, the base frame may be formed from a plurality of pieces of electrically conductive material. The plurality of pieces of electrically conductive material may be secured together. The plurality of pieces of electrically conductive material may be secured together by the support frame.

The base frame may be formed by any suitable means. Preferably, the base frame is formed by one or more of pressing, stamping, punching and bending. Preferably, the step of providing the base frame may comprise providing a blank for the base frame, and pressing the blank into a predetermined shape to form the base frame. The blank may be pressed between a pressing tool and a die. The step of pressing may comprise punching. In other words, the step of pressing may comprise punching one or more holes through the blank.

In embodiments in which different portions of the base frame are electrically isolated from each other, the step of forming the base frame may comprise the step of separating one portion of the base frame from another. For example, a portion of the base frame forming a ground plane may be separated from a portion of the base frame forming an electrical track. Such separation may be performed during a pressing procedure, for example, by punching a hole between the two portions of the blank to separate the two portions of the base frame.

In embodiments comprising one or more pins for electrically connecting a ground plane portion or an electrical track to a component of an aerosol-generating device comprising the frame, the one or more pins may be formed in any suitable manner. A pin may be formed with the ground plane portion or electrical data track in a pressing, stamping or punching process. A pin may be provided as a physically separate component to the base frame and may be secured to a ground plane portion or electrical data track. For example, a pin may be laser welded to a ground plane portion or electrical data track.

The base frame is preferably configured to form a power supply cavity configured to receive an electrical power supply of an aerosol-generating device. The power supply cavity preferably has an open portion to permit insertion of an electrical power supply into the power supply cavity and removal of the power supply from the power supply cavity. The power supply cavity may be provided towards a distal end of the frame. The power supply cavity may be arranged adjacent to the electrical connector.

The power supply cavity may be configured to retain an electrical power supply of the aerosol-generating device. The base frame may comprise means to retain the electrical power supply in the power supply cavity. For example, the base frame may comprise one or more resilient elements at the open portion of the power supply cavity. The one or more resilient elements may define a width of the open portion that is less than the width of the electrical power supply. The power supply cavity may have a width at the open portion that is less than the width of the electrical power supply. At least the portion of the base frame forming the power supply cavity may be resilient, such that the power supply may be inserted into the cavity by increasing the width of the open portion of the cavity. Preferably, an inner surface of the power supply cavity is configured to electrically connect the power supply to the base frame.

The base frame is preferably configured to receive an electronic circuit board of the aerosol-generating device. The base frame is preferably configured to be electrically connected to an electronic circuit board of the aerosol-generating device comprising the frame. A proximal end of an electrical track of the base frame may be configured to electrically connect to an electronic circuit board of an aerosol-generating device comprising the frame. A proximal end of a ground plane portion of the base frame may be configured to electrically connect to an electronic circuit board of an aerosol-generating device comprising the frame.

The base frame may comprise one or more pins configured to electrically connect the base frame to an electronic circuit board of an aerosol-generating device comprising the frame. The base frame may comprise a plurality of pins. The plurality of pins may be configured to extend parallel to each other. The pins may be arranged to electrically connect to electronic components of an aerosol-generating device comprising the frame.

The frame comprises a support frame formed from an electrically insulating material, the base frame and electrical connector being at least partially embedded in the support frame.

Preferably, the support frame is integrally moulded with the base frame and the electrical connector. In other words, the support frame is moulded over at least a portion of the base frame and a portion of the electrical connector.

Preferably, the support frame is formed by overmoulding electrically insulating material over the base frame and the electrical connector to at least partially embed the base frame and the electrical connector in the support frame.

The support frame may have any suitable shape and configuration.

The support frame may define at least a portion of a cavity for receiving an electrical power supply of an aerosol-generating device comprising the frame. The support frame may comprise a substantially arcuate portion defining at least a portion of a cavity for receiving an electrical power supply. The cavity for receiving an electrical power supply of an aerosol-generating device may be located towards a distal end of the frame.

The support frame may comprise a seat for receiving an electronic circuit board of an aerosol-generating device comprising the frame. The seat may comprise a cavity in the support frame having a shape and configuration complementary to that of an electronic circuit board of the aerosol-generating device. The seat for receiving an electronic circuit board of an aerosol-generating device may be arranged towards a proximal end of the frame.

The support frame may comprise a cavity for receiving an aerosol generator of an aerosol-generating device. The cavity for receiving an aerosol generator may be located at a proximal end of the aerosol-generating device. The cavity for receiving an aerosol generator may be configured to receive a mount or base of an aerosol generator.

In some preferred embodiments, the support frame at least partially overlaps the electrical connection between the base frame and the electrical contact. Advantageously, overlapping the electrical connection between the base frame and the electrical contact of the electrical connector may provide a more robust structural and electrical connection between the base frame and the electrical contact of the electrical connector.

In some embodiments, the base frame and the electrical connector meet at an interface. Preferably, the support frame at least partially overlaps the interface between the base frame and the electrical connector. Advantageously, at least partially overlapping the interface between the base frame and the electrical connector may provide a more robust structural and electrical connection between the base frame and the electrical contact of the electrical connector.

In some embodiments, the support frame at least partially circumscribes the electrical connector. Advantageously, this may provide a particularly robust structural connection between the support frame and the electrical connector.

The support frame may at least partially extend over the rear or proximal face of the electrical connector. The support frame may at least partially overlap the rear or proximal face of the electrical connector. In some embodiments, a rear or proximal face of the electrical connector may define an end of a power supply cavity of the frame. The support frame may substantially extend over the rear or proximal face of the electrical connector, such that the support frame defines an end face of a power supply cavity of the frame for receiving a power supply of an aerosol-generating device comprising the frame. Advantageously, extending the support frame over at least a portion of a rear or proximal end face of the electrical connector such that the support frame defines an end face of a power supply cavity of the frame may ensure that an end of an electrical power supply received in the power supply cavity is electrically isolated from one or more electrical contacts of the electrical connector.

According to this disclosure, there may also be provided an aerosol-generating device. The aerosol-generating device may comprise a frame comprising a base frame formed from an electrically conductive material; an electrical connector having an electrical contact, the electrical connector being secured to the base frame such that the base frame is electrically connected to the electrical contact of the electrical connector; and a support frame formed from an electrically insulating material, the base frame and electrical connector being at least partially embedded in the support frame. The aerosol-generating device may further comprise: an electrical power supply supported by the frame; and an electronic circuit board supported by the frame.

The electrical contact of the electrical connector may form an electrical power contact of the aerosol-generating device. The electrical power contact may be arranged for electrical connection with an external power supply. The base frame may comprise an electrical power track electrically connected to the electrical power contact of the electrical connector. The electrical power track may be configured to electrically connect the electrical power contact to the electronic circuit board.

In preferred embodiments, the electrical connector further comprises an electrical contact forming a data contact. The data contact may be arranged for electrical connection with an external device. The base frame may comprise an electrical data track electrically connected to the data contact of the electrical connector. The electrical data track may be configured to electrically connect the data contact to the electronic circuit board.

In preferred embodiments, the electrical connector further comprises an electrical contact forming a ground contact. The ground contact may be arranged for electrical connection with a ground contact of an external device. The base frame may comprise a ground plane electrically connected to the ground contact of the electrical connector. The ground plane may be configured to electrically connect the ground contact to the electronic circuit board. The ground plane may be electrically connected to a negative terminal of the electrical power supply.

The aerosol-generating device comprises an electronic circuit board. Preferably, the aerosol-generating device comprises a controller disposed on the electronic circuit board. The electronic circuit board may comprise the controller. The controller may comprise a microprocessor, which may be a programmable microprocessor, a microcontroller, or an application specific integrated chip (ASIC) or other electronic circuitry capable of providing control. The controller may comprise further electronic components.

The aerosol-generating device comprises an electrical power supply. The power supply may be a DC power supply. In preferred embodiments, the power supply is a battery. The power supply may be a nickel-metal hydride battery, a nickel cadmium battery, or a lithium based battery, for example a lithium-cobalt, a lithium-iron-phosphate or a lithium-polymer battery. However, in some embodiments the power supply may be another form of charge storage device, such as a capacitor. The power supply may require recharging and may have a capacity that allows for the storage of enough energy for one or more user operations, for example one or more aerosol-generating experiences. For example, the power supply may have sufficient capacity to allow for continuous heating of an aerosol-forming substrate for a period of around six minutes, corresponding to the typical time taken to smoke a conventional cigarette, or for a period that is a multiple of six minutes. In another example, the power supply may have sufficient capacity to allow for a predetermined number of puffs or discrete activations of the aerosol generator.

Preferably the aerosol-generating device comprises a cavity for receiving an aerosol-forming substrate. Preferably the cavity for receiving aerosol-forming substrate is at a proximal end of the device. Particularly preferably, the cavity for receiving an aerosol-forming substrate is at a proximal end of the device, and the electrical connector is at a distal end of the aerosol-generating device, opposite the proximal end.

The aerosol-generating device may comprise an aerosol generator. The aerosol generator may be arranged to generate aerosol from an aerosol-forming substrate received in the device. Preferably, the aerosol generator is configured to receive power from the electrical power supply via the electronic circuit board. The aerosol generator may be supported by the frame.

The aerosol generator may comprise an electric heater.

The electric heater may comprise at least one internal heating element. As used herein, the term "internal heating element" refers to a heating element configured to be inserted into an aerosol-forming substrate. The internal heating element may be in the form of at least one of a blade, a pin, and a cone. The internal heating element is preferably configured to be insertable into an aerosol forming substrate. In embodiments in which the aerosol-generating device comprises a cavity for receiving an aerosol-forming substrate, preferably the at least one internal heating element extends into the cavity.

The electric heater may comprise at least one external heating element. As used herein, the term "external heating element" refers to a heating element configured to heat an outer surface of an aerosol-forming substrate. The at least one external heating element is preferably configured to at least partially surround an aerosol forming substrate received by the aerosol-generating device. In embodiments in which the aerosol-generating device comprises a cavity for receiving an aerosol-forming substrate, preferably the at least one external heating element at least partially surrounds the cavity.

In some embodiments, the heater comprises at least one internal heating element, and at least one external heating element.

The heater may comprise a resistive heating element. Preferably the heater comprises a resistive heating element comprising a rigid electrically insulating substrate with one or more electrically conductive tracks or wire disposed on its surface. Preferably the size and shape of the electrically insulating substrate allow it to be inserted directly into an aerosol-forming substrate. If the electrically insulating substrate is not sufficiently rigid, the heating element may comprise a further reinforcement means. A current may be passed through the one or more electrically conductive tracks to heat the heating element and the aerosol-forming substrate. The resistive heating element may be located in the cavity. The aerosol-generating device may comprise only one resistive heating element. The aerosol-generating device may comprise a plurality of resistive heating elements.

The aerosol generator may comprise a transfer element. The transfer element may be arranged to transfer a liquid aerosol-forming substrate to the electric heater. The transfer element may comprise a capillary wick. Preferably, the electric heater contacts the transfer element. The electric heater may comprise a resistive heating wire. At least a portion of the resistive heating wire may be coiled around the transfer element. The electric heater may comprise a resistive heating mesh.

The aerosol-generator may comprises an inductive heating arrangement. The inductive heating arrangement may comprise an inductor coil and a power supply configured to provide high frequency oscillating current to the inductor coil. As used herein, the term "high frequency oscillating current" means an oscillating current having a frequency of between 500 kilohertz kHz and 30 megahertz MHz. The at least one heater may advantageously comprise a DC/AC inverter for converting a DC current supplied by a DC power supply to the alternating current. The inductor coil may be arranged to generate a high frequency oscillating electromagnetic field on receiving a high frequency oscillating current from the power supply. The inductor coil may be arranged to generate a high frequency oscillating electromagnetic field in a device cavity configured to receive an aerosol-forming substrate. In some preferred embodiments, the inductor coil may substantially circumscribe the device cavity. The inductor coil may extend at least partially along the length of the device cavity.

In embodiments in which the aerosol generator comprises an inductive heating arrangement, the aerosol generator may comprise an inductive heating element. The inductive heating element may be a susceptor element. As used herein, the term "susceptor element" refers to an element comprising a material that is capable of converting electromagnetic energy into heat. When a susceptor element is located in an alternating electromagnetic field, the susceptor is heated. Heating of the susceptor element may be the result of at least one of hysteresis losses and eddy currents induced in the susceptor, depending on the electrical and magnetic properties of the susceptor material. A susceptor element may be arranged such that, when the aerosol-generating article is received in the device cavity, the oscillating electromagnetic field generated by the inductor coil induces a current in the susceptor element, causing the susceptor element to heat up. The susceptor element may be located in the cavity. The aerosol-generating device may comprise only one susceptor element. The aerosol-generating device may comprise a plurality of susceptor elements.

A susceptor element may comprise any suitable material. The susceptor element may be formed from any material that can be inductively heated to a temperature sufficient to release volatile compounds from the aerosol-forming substrate. Suitable materials for the elongate susceptor element include graphite, molybdenum, silicon carbide, stainless steels, niobium, aluminium, nickel, nickel containing compounds, titanium, and composites of metallic materials. Preferred susceptor elements comprise a metal or carbon. Advantageously the susceptor element may comprise or consist of a ferromagnetic material, for example, ferritic iron, a ferromagnetic alloy, such as ferromagnetic steel or stainless steel, ferromagnetic particles, and ferrite.

The aerosol generator may comprise an element arranged to oscillate when supplied with power from the power supply. The aerosol generator may comprise a piezoelectric element. The aerosol-generator may comprise at least one nozzle. The piezoelectric element may be arranged to eject droplets of a liquid aerosol-forming substrate through the at least one nozzle. The aerosol generator may comprise a mesh, wherein the mesh defines the at least one nozzle.

The mesh may be arranged to oscillate during use of the aerosol-generating device. An oscillating mesh may be termed an "active mesh". The mesh may be formed from a piezoelectric material. The mesh may be the piezoelectric element. The piezoelectric element may be formed separately from the mesh and arranged to oscillate the mesh during use.

The mesh may be arranged to remain substantially stationary with respect to the oscillating piezoelectric element during use of the aerosol-generating device. A stationary mesh may be termed a "passive mesh". The aerosol generator may comprise a reservoir positioned between the mesh and the piezoelectric element. The reservoir may be arranged to receive a liquid aerosol-forming substrate.

Preferably, the aerosol-generating device comprises a housing. The housing may at least partially define the cavity for receiving an aerosol-forming substrate. The housing may have a proximal end and a distal end. The cavity for receiving aerosol-forming substrate may be arranged at the proximal end of the device. At least a portion of the heater of the aerosol-generating device may extend into the cavity. In particular, in embodiments comprising an internal heater a portion of the heater may extend into the cavity for receiving aerosol-forming substrate.

The housing may be elongate. Preferably, the housing is cylindrical in shape. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

Preferably the aerosol-generating device is portable. The aerosol-generating device may have a length of between approximately 70 millimetres and approximately 120 millimetres. The aerosol-generating device may be a handheld device. In other words, the aerosol-generating device may be sized and shaped to be held in the hand of a user.

In some embodiments, the housing may comprise an elongate hollow tube. The frame, and the components supported on the frame, may be provided within the elongate hollow tube. The transverse cross-sectional shape of the elongate hollow tube is preferably circular. The elongate hollow tube may be formed from a metal, such as aluminium. The elongate hollow tube may improve the durability of the device by providing additional protection to the frame and electrical components supported by the frame both during manufacture and use. The length of the elongate hollow tube is preferably greater than the length of the frame. The length of the elongate hollow tube may be greater than the total length of the frame and the heater, when the heater is mounted to the frame. In this way, the elongate hollow tube may form the cavity for receiving aerosol-forming substrate. In addition, by providing an elongate hollow tube which extends to cover the heater, the heating element may protected both during manufacture and use of the aerosol-generating device.

Any feature described in relation to a method of manufacture according to this disclosure may also be applied to a frame and an aerosol-generating device according to this disclosure. Any feature described in relation to a frame or an aerosol-generating device according to this disclosure may also be applied to a method of manufacture according to this disclosure.

It should also be appreciated that particular combinations of the various features described above may be implemented, supplied, and used independently.

Embodiments of the present disclosure will now be described, by way of example only, with reference to the accompanying drawings, in which.

Figure 4:
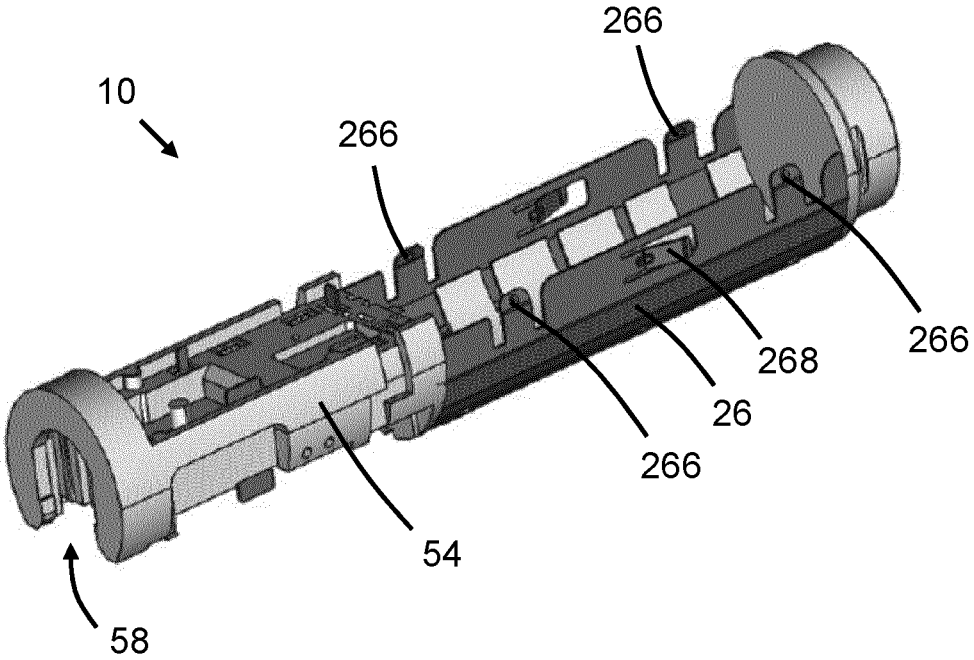
FIG. 4 shows another perspective view of the frame of FIG. 3.
Figure 5:
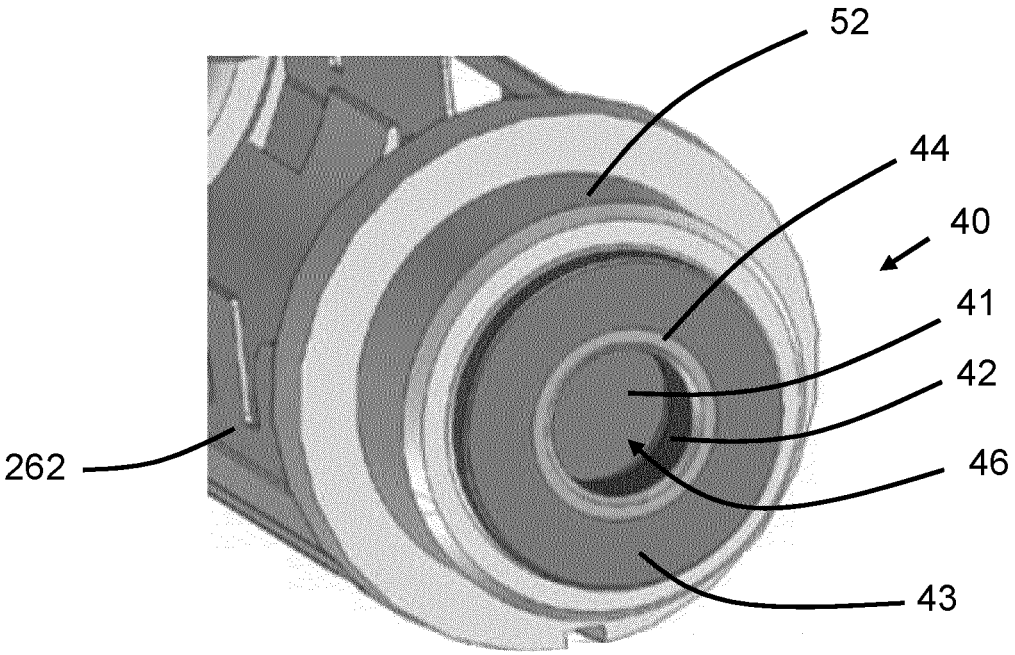
FIG. 5 shows a perspective view of a distal end of the frame of FIG. 3.
Figure 6:
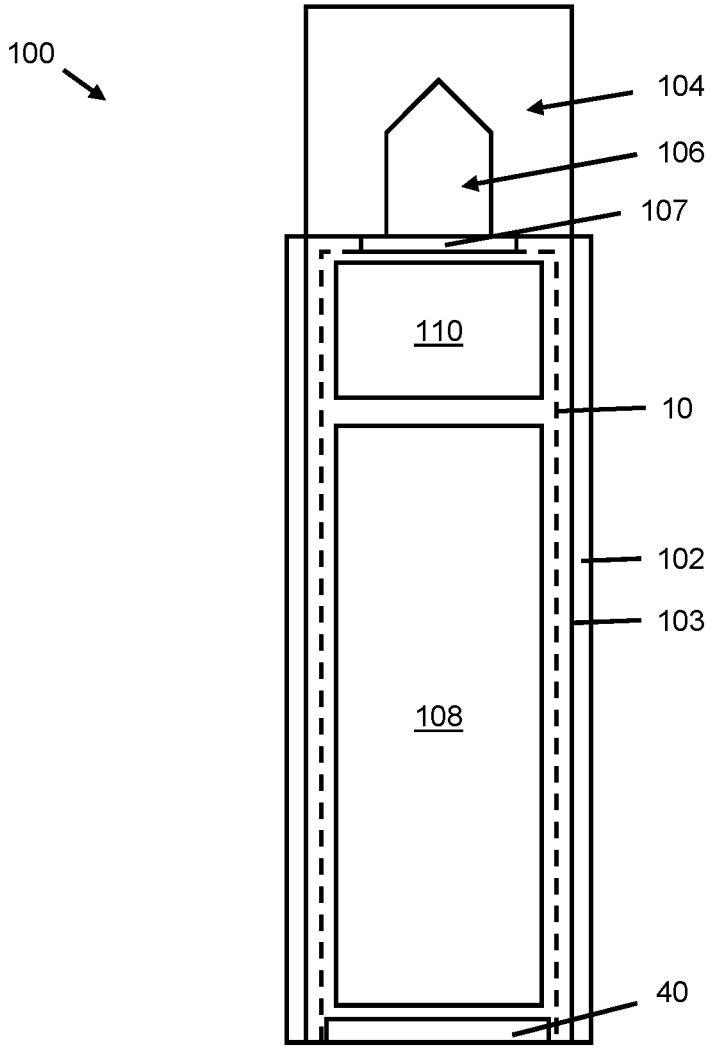
Figure 7:
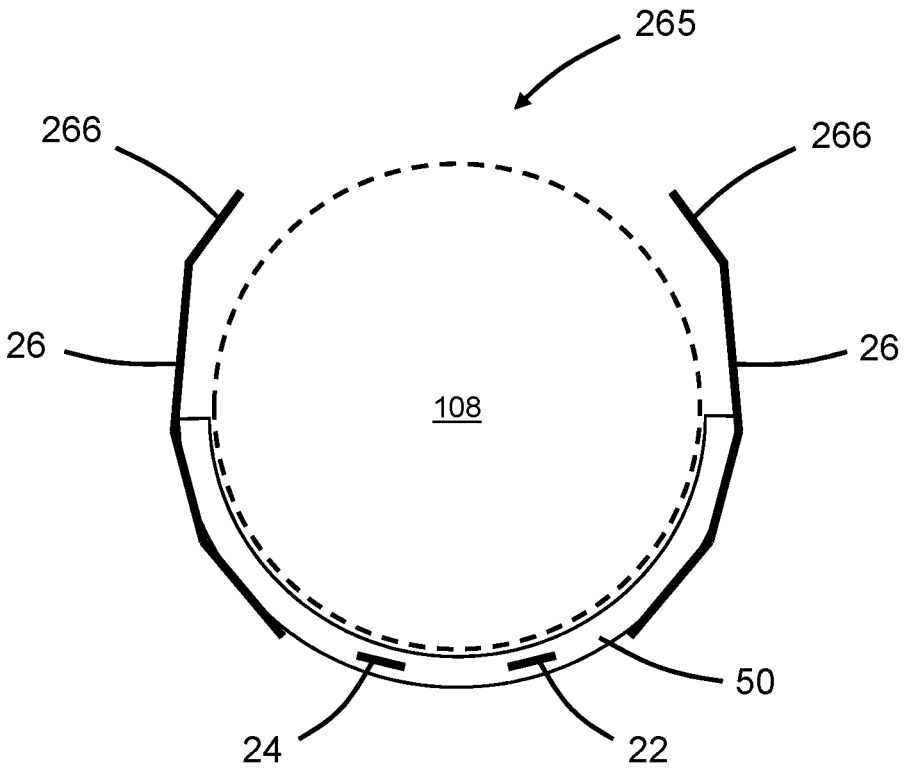
Figure 8:
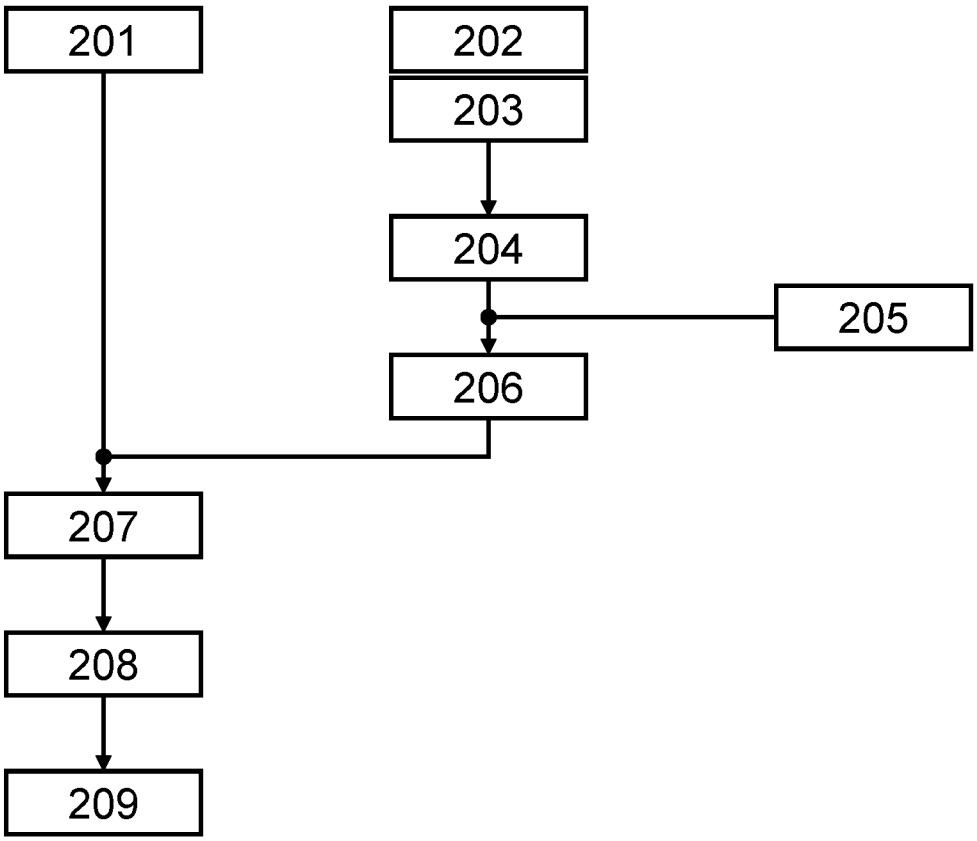

FIG. 6 shows a schematic illustration of an aerosol-generating device in accordance with an embodiment of the present disclosure; and FIG. 7 shows a schematic illustration of a lateral cross-section through the power supply cavity of the aerosol-generating system of FIG. 6; and FIG. 8 shows a flow diagram of a method of manufacture of the frame of FIGS. 1 to 7, in accordance with an embodiment of the present disclosure.

FIGS. 1 to 7 show schematic illustrations of a frame 10 for an aerosol-generating device 100 in accordance with an embodiment of the present disclosure. The frame 10 provides support for electrical components of the aerosol-generating device 100 and electrically conductive pathways that enable electrical connection of different electrical components of the aerosol-generating device 100. The frame of the present disclosure is particularly compact and straightforward to manufacture in comparison to other known frames for aerosol-generating devices.

Figure 1:
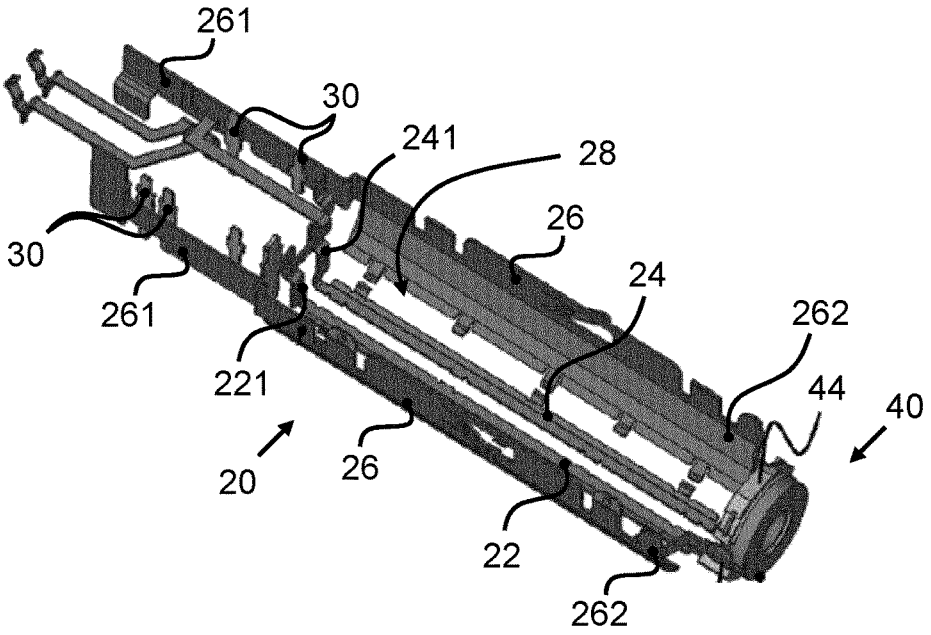
FIG. 1 shows a perspective view of a base frame and electrical connector of a frame for an aerosol-generating device in accordance with an embodiment of the present disclosure.
Figure 2:
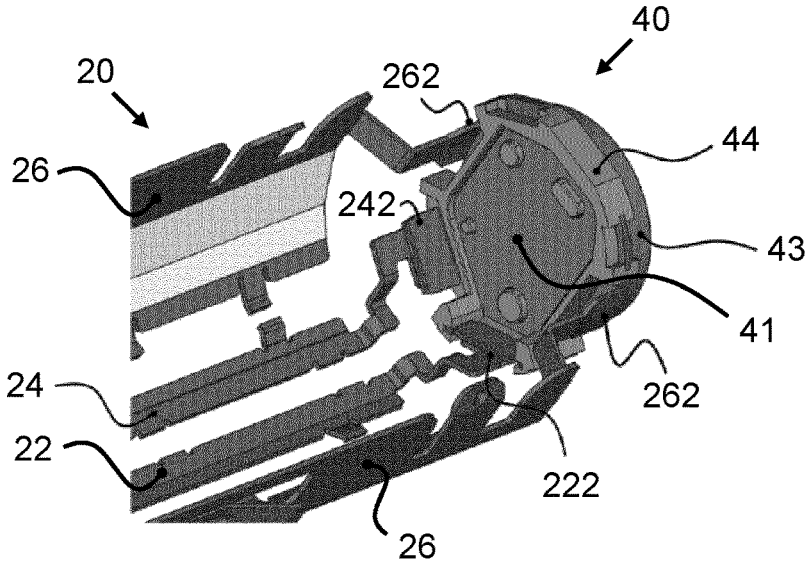
FIG. 2 shows a perspective view of the electrical connection of the base frame and the electrical connector of FIG. 1.

FIG. 1 shows a perspective view of a base frame 20 and electrical connector 40 for use in an aerosol-generating device. The aerosol-generating device is described in further detail below.

The base frame 20 is elongate, and comprises a proximal end and a distal end, opposite the proximal end. The electrical connector 40 is disposed at the distal end of the base frame 20.

The base frame 20 generally comprises a plurality of elongate electrically conductive elements. More specifically, the base frame 20 comprises two electrical tracks 22, 24 disposed between two ground plane portions 26. A first electrical track 22 comprises a proximal end 221 and a distal end 222. A second electrical track 24 comprises a proximal end 241 and a distal end 242. Each ground plane portion 26 comprises a proximal end 261 and a distal end 262.

In this embodiment, the base frame 20 is formed by pressing a single laminar blank. In this embodiment, the blank is formed from brass. The laminar blank may be stamped either in a single stamping process or in multiple stamping processes to fold the blank into the desired shape and to punch holes between portions of the blank, to electrically isolate the first electrical track 22 from the second electrical track 24 and to electrically isolate the first and second electrical tracks 22, 24 from the ground plane portions 26.

The electrically conductive elements are arranged and shaped to form a cavity 28 suitable for receiving an electrical power supply of an aerosol-generating device, in a position between the proximal and distal ends of the electrically conductive elements.

Towards the proximal ends 221, 241, 261 of the electrical tracks 22, 24 and the ground plane portions 26, the electrically conductive elements are provided with a plurality of electrically conductive pins 30. The pins 30 are configured to electrically connect the base frame 20 to an electronic circuit board, such as a PCB, of an aerosol-generating device. Some of the pins 30 are formed by shaping the proximal ends of the electrically conductive elements of the base frame 20, and some of the pins 30 are formed from separate elements of phosphor bronze. Pins 30 formed from separate elements of phosphor bronze are laser welded to the electrically conductive elements of the base frame 20 at the required locations.

The electrical connector 40 comprises three electrical contacts 41, 42, 43 supported on a connector frame 44. As shown in detail in FIG. 5, the electrical connector 40 generally comprises an annular front face, primarily defined by the third electrical contact 43, and a central recess 46 extending inwards from the front face. The recess 46 is substantially cylindrical, has a closed end formed by the first electrical contact 41, and a side wall substantially formed by the second electrical contact 42 extending between closed end and the front face.

The first and second electrical contacts 41, 42 are formed from phosphor bronze. The third electrical contact 43 is formed from an alloy of neodymium, such that the third electrical contact 43 forms a magnetic contact that may magnetically attract a complementary magnetic element of a complementary electrical connector. The first electrical contact 41 comprises a substantially planar metallic sheet, having a tab at one end bent substantially perpendicular to the sheet, for connection of the first electrical contact 41 to the base frame. The second electrical contact 42 comprises a substantially annular metallic sheet, forming a cylindrical tube, having a tab at one end that is bent to extend in the same direction as the tab of the first electrical contact 42 when the first and second electrical contacts 41, 42 are positioned in the electrical connector 40. The third electrical contact 43 forms an annular metallic disc. The third electrical contact 43 has a central passage with a diameter that is substantially similar to the outer diameter of the cylindrical tube of the second electrical contact 42. Accordingly, the second electrical contact 42 may fit within the central passage of the third electrical contact 43, with the third electrical contact 43 circumscribing the second electrical contact 42.

The second electrical contact 42 and the third electrical contact 43 are partially embedded in the connector frame 44. The connector frame 44 is formed from a mouldable polymer material, polyphthalamide (PPA), which is injection moulded over the second and third electrical contacts 42, 43. Overmoulding the second and third electrical contacts 42, 43 secures the second and third electrical contacts 42, 43 in the connector frame 44, and maintains a necessary separation between the second and third electrical contacts 42, 43 for electrical isolation from each other.

The connector frame 44 and the second and third electrical contacts 42, 43 generally form an annular disc, having a central passage that is open at both ends. The third electrical contact 43 generally forms the front face of the disc, and the second electrical contact 42 generally forms the inner wall of the central passage. The first electrical contact 41 is arranged at a rear face of the connector frame 44, opposite the third electrical contact 43 at the front face, and extends over one of the open ends of the central passage to form the closed end of the central recess 46. The first electrical contact 41 is positioned against a rear face of the connector frame 44, such that the first electrical contact 41 is electrically isolated from the second and third electrical contacts 42, 43.

The distal end 222 of the first electrical track 22 of the base frame 20 is in physical contact with the tab of the first electrical contact 41 of the electrical connector 40, such that the first electrical track 22 is electrically connected to the first electrical contact 41. The distal end 242 of the second electrical track 24 of the base frame 20 is in physical contact with the tab of the second electrical contact 42 of the electrical connector 40, such that the second electrical track 24 is electrically connected to the second electrical contact 42. The distal ends 262 of the ground plane portions 26 of the base frame 20 are in physical contact with the cylindrical outer sidewall of the third electrical contact 43 of the electrical connector 40, such that the ground plane portions 26 of the base frame 20 are electrically connected to the third electrical contact 43.

The distal portions 222, 242 of the first and second electrical tracks 22, 24 are laser welded to tabs of the first and second electrical contacts 41, 42, and the distal portions 262 of the base frame portions 26 of the base frame 20 are laser welded to the outer sidewall of the third electrical contact 43. Accordingly, in this embodiment, the base frame 20 is secured to the electrical connector 40 at all of the locations of the base frame 20 that are in physical contact with the electrical connector 40. It will be appreciated that in other embodiments the electrical contacts of the electrical connector may not be secured to the base frame, and in other embodiments only some of the electrical contacts may be secured to the base frame.

Figure 3:
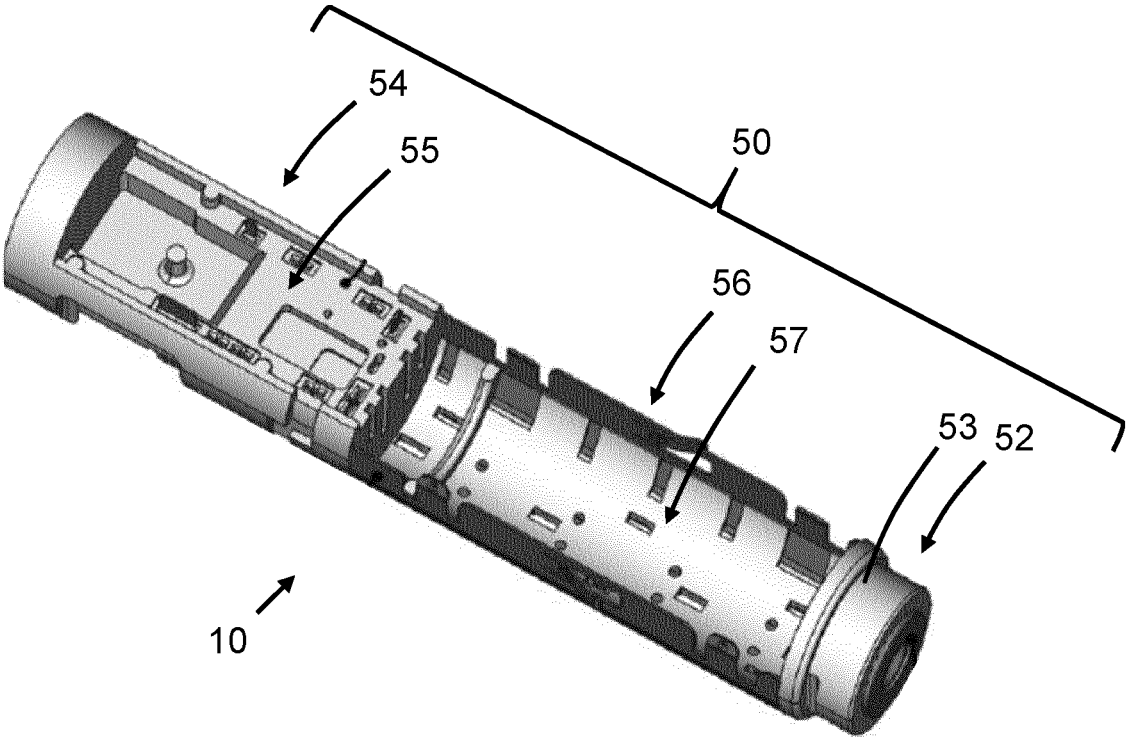
FIG. 3 shows a perspective view of the base frame and electrical connector of FIG. 1 partially embedded in a support frame to form a frame for an aerosol-generating device in accordance with an embodiment of the present disclosure.

As shown in FIGS. 3, 4 and 5, the base frame 20 and electrical connector 40 are partially embedded in a support frame 50 to form the complete frame 10. In this embodiment, the support frame 50 is formed from a mouldable polymer material, polyphthalamide (PPA), which is injection moulded over the base frame 20 and electrical connector 40.

At a distal end 52 of the support frame 50, the rear end of the electrical connector 40 and the distal ends 222, 242, 262 of the electrically conductive elements of the base frame 20 are embedded in a portion of the support frame 50. A distal end portion 53 of the support frame 50 generally circumscribes and extends over the cylindrical outer sidewall of the third electrical contact 43 and the base frame 20. The distal end portion 53 of the support frame 50 also extends over the rear face of the connector frame 44 and the first electrical contact 41. Accordingly, the distal end portion 53 of the support frame 50 overlaps the interface between the base frame 20 and the electrical connector 40. In more detail, the distal end portion 53 of the support frame 50 extends over the connection between the distal end 222 of the first electrical track 22 of the base frame 20 with the tab of the first electrical contact 41 of the electrical connector 40, extends over the connection between the distal end 242 of the second electrical track 24 of the base frame 20 with the tab of the second electrical contact 42 of the electrical connector 40, and extends over the connection between the distal ends 262 of the ground plane portions 26 of the base frame 20 and the outer sidewall of the third electrical contact 43 of the electrical connector. In this way, the support frame 50 further secures the connection between the base frame 20 and the electrical connector 40.

The front face of the electrical connector 40 is not covered by the support frame 50, such that the front face of the third electrical contact 43 and the first and second electrical contacts 41, 42 in the recess 46 are exposed. This enables the first, second, and third electrical contacts 41, 42, 43 to be brought into contact with complementary electrical contacts of a complementary electrical connector.

At a proximal end 54 of the support frame 50, the support frame 50 forms a seat 55 for receiving an electronic circuit board of an aerosol-generating device. The seat 55 generally comprises a shallow, rectangular cavity suitable for receiving an electronic circuit board, and includes additional deeper inner cavities arranged within the shallow cavity for receiving electrical components connected to the electronic circuit board. At the proximal end 54 of the support frame 50, the support frame 50 further comprises openings arranged to enable the proximal ends 221, 241, 261 of the electrically conductive elements of the base frame 20, and pins 30, to extend through the support frame 50, and electrically connect to an electronic circuit board received in the seat 55.

An intermediate portion 56 of the support frame 50, disposed between the distal end 52 and proximal end 54, defines a power supply cavity 57 for receiving an electrical power supply of an aerosol-generating device. The power supply cavity 57 comprises the cavity 28 defined by the electrically conductive elements of the base frame 20, and a generally arcuate portion of the support frame 50, as shown in the lateral cross-section of FIG. 7. At the intermediate portion 56 of the support frame 50, the first and second electrical tracks 22, 24 are fully embedded in the arcuate portion of the support frame 50, and inner faces of the ground plane portions 26 of the base frame 20 are embedded in the arcuate portion of the support frame 50. Accordingly, the arcuate portion of the support frame 50 maintains a desired separation between the electrically conductive elements of the base frame 20. An inner surface of the arcuate portion of the support frame 50 is shaped to complement the outer surface of an electrical power supply of an aerosol-generating device, which enables the arcuate portion of the support frame 50 to cradle an electrical power supply, and inhibit movement of the electrical power supply within the power supply cavity 57.

At the power supply cavity 57, the ground plane portions 26 of the base frame 20 are bent into a substantially arcuate shape. Upper ends of the ground plane portions 26, opposite lower ends adjacent to the first and second electrical tracks 22, 24, are not embedded in the support frame 50. The upper ends of the ground plane portions 26 define an opening 265 to enable an electrical power supply to be inserted into the power supply cavity 57 and removed from the power supply cavity 57. Pairs of opposing resilient portions 266 are spaced at regular intervals along the length of the power supply cavity 57, at the upper ends of the ground plane portions 26. As shown in FIG. 7, each pair of opposing resilient portions 266 is bent to define a width of the opening 265 that is less than the diameter of an electrical power supply of an aerosol-generating device. This helps to retain an electrical power supply of an aerosol-generating device in the power supply cavity 57, as the opposing pairs of resilient portions 266 are required to be forced apart in order to be able to remove an electrical power supply from the electrical power supply cavity 57.

A further pair of opposing resilient portions 268 are arranged at the upper ends of the ground plane portions 26, and are bent outwards to engage with the housing of an aerosol-generating device. These further pair of opposing resilient portions 268 are bent inwards when the frame 10 is received in the housing of an aerosol-generating device, and press on an inner surface of the housing to provide an increased frictional force between the frame 10 and the housing of the aerosol-generating device. As such, the further pair of opposing resilient portions 268 help to retain the frame 10 within the housing of the aerosol-generating device.

At the proximal end of the support frame 50, the support frame defines a heater cavity 58 for receiving a base of a heater of an aerosol-generating device. Accordingly, the frame 10 is configured to receive and support an electrical power supply, an electronic circuit board and a heater of an aerosol-generating device.

FIGS. 6 and 7 show a schematic illustration of an aerosol-generating device 100 comprising the frame 10.

The aerosol-generating device 100 is a device configured to receive an aerosol-generating article (not shown) comprising a solid aerosol-forming substrate and a filter wrapped together in the form of a rod like a conventional cigarette. The aerosol-generating device 100 is a portable device that is configured to be held in the hand of a user, having a length of about 90 mm, a diameter of about 14 mm.

The aerosol-generating device 100 comprises an outer housing 102, which is generally cylindrical, and formed from a light and brittle plastics material, such as PEEK. The aerosol-generating device 100 also includes an inner housing 103, comprising a hollow cylindrical tube of aluminium that extends the length of the outer housing 102 and beyond a proximal end of the inner housing 103 to form an open, cylindrical cavity 104. The open, cylindrical cavity 104 is configured to receive the aerosol-forming substrate of an aerosol-generating article. An elongate heater 106, in the form of blade, extends into the cavity 104 for penetrating into the aerosol-forming substrate of an aerosol-generating article received in the cavity 104. The heater 106 comprises a blade having a plurality of resistive heating elements or tracks disposed on an electrically insulating polyimide substrate extending from a base 107.

A power supply 108, in the form of a lithium-ion battery with a capacity of about 120 milliampere-hours, is housed within the housing 102.

An electronic circuit board 110 is also housed within the housing 102. The electronic circuit board 110 comprises a controller having a microprocessor (not shown) mounted on a printed circuit board. The electronic circuit board 110 is connected to the heater 106 and the power supply 108, and the electronic circuit board 110 is configured to control the supply of power from the power supply 108 to the heater 106.

In this embodiment, the controller is configured to measure the resistance of one of the electrically resistive heating elements of the heater 106. The electrical resistance of the electrically resistive heating element provides an indication of the temperature of the heater 106. The controller is configured to control the temperature of the heater 106 by controlling the power supplied from the power supply 108 to the heater 106 based on measurements of resistance of the electrically resistive heating element.

The heater 106, electrical power supply 108 and electronic circuit board 110 are received by the frame 10 and supported by the frame 10. The base 107 of the heater 106 is received in the heater cavity 58 of the support frame 50. The electrical power supply 108 is received in the power supply cavity 57, as shown in FIG. 7. The electronic circuit board 110 is received in the seat 55 of the frame 10. The frame 10, heater 106, electrical power supply 108 and electronic circuit board 110 are all received in the inner housing 103, which provides some protection to the components from impacts and general wear and tear.

The electrical connector 40 at the distal end of the frame 10 is arranged at a distal end of the outer housing 102, opposite the cavity 104, and forms the distal end face of the aerosol-generating device 100.

The electronic circuit board 110 is electrically connected to each of the first, second and third electrical contacts 41, 42, 43 via the base frame 20.

The proximal ends 221, 241, 261 of the electrically conductive elements of the base frame 20, and the electrically conductive pins 30, extend through openings in the support frame 50 and are electrically connected to the electronic circuit board 110.

The first electrical contact 41 of the electrical connector 40 is connected to the electronic circuit board 110 via the first electrical track 22 of the base frame 20. In this embodiment, the first electrical track 22 and the first electrical contact 41 are configured for the transfer of power from an external power supply to the electronic circuit board 110. Accordingly, the first electrical track 22 may be referred to as the power track. The controller of the electronic circuit board 110 is configured to control the supply of power from an external power supply to the power supply 108 of the aerosol-generating device 100 for recharging the power supply.

The second electrical contact 42 of the electrical connector 40 is connected to the electronic circuit board 110 via the second electrical track 24 of the base frame 20. In this embodiment, the second electrical track 24 and the second electrical contact 42 are configured for the transfer of data from an external device to the electronic circuit board 110. Accordingly, the second electrical track 24 may be referred to as the data track. The controller of the electronic circuit board 110 is configured to control the transfer of data between an external device and the controller of the aerosol-generating device 100.

The third electrical contact 43 of the electrical connector 40 is connected to the electronic circuit board 110 via both ground plane portions 26 of the base frame 20. In this embodiment, the ground plane portions 26 of the base frame 20 appear as an infinite ground potential to the components of electrical circuit board 110, such that the electrical connection of the electronic circuit board 110 to the ground plane portions 26 of the base frame enables the components of the electronic circuit board to be grounded. Furthermore, the third electrical contact 43 of the electrical connector 40 is configured to be connected to a corresponding ground contact of a complementary electrical connector.

It will be appreciated that in other embodiments of the disclosure other components of the aerosol-generating device may be connected to each other via portions of the base frame 20. For example, a heater of an aerosol-generating device may be directly connected to an electrical contact of the electrical connector, for direct supply of power from an external power supply to a heater of the aerosol-generating device. For example, a positive terminal of an electrical power supply of the aerosol-generating device may be connected to an electronic circuit board of the aerosol-generating device via a portion of the base frame. In addition, the electrical connector may be provided with different numbers of electrical contacts.

FIG. 8 shows a flowchart for a method of manufacture of the frame 10 of FIGS. 1 to 7 according to an embodiment of the present disclosure.

In a first step 201, a blank in the form of a laminar sheet of brass is pressed to form the base frame 20, having the first electrical track 22, the second electrical track 24 and the ground plane portions 26.

In a second step 202, an annular disc of a neodymium alloy is provided to form the third electrical contact 43.

In a third step 203, an annular ring of phosphor bronze is provided to form the second electrical contact 42.

In a fourth step 204, the third electrical contact 43 and the second electrical contact 42 are overmoulded with PPA in an injection moulding process to form the connector frame 44, with the second and third electrical contacts 42, 43 being partially embedded in the connector frame 44.

In a fifth step 205, a substantially planar sheet of phosphor bronze is provided to form the first electrical contact 41.

In a sixth step 206, the first electrical contact 41 is arranged at a rear face of the connector frame 44, such that the first, second, and third electrical contacts 41, 42, 43 and the connector frame 44 form the electrical connector 40.

In a seventh step 207, the electrical connector 40 is arranged at the distal end of the base frame 20, with the distal ends 222, 242, 262 of the electrically conductive elements of the base frame 20 in contact with the electrical contacts 41, 42, 43 of the electrical connector.

In an eighth step 208, the electrical contacts 41, 42, 43 of the electrical connector 40 are laser welded to the distal ends 222, 242, 262 of the electrically conductive elements of the base frame 20. More specifically, the first electrical contact 41 is laser welded to the distal end 222 of the first electrical track 22, the second electrical contact 42 is laser welded to the distal end 242 of the second electrical track 24, and the third electrical contact 43 is laser welded to the distal ends 262 of the ground plane portions 26 of the base frame 20.

In a ninth step 209, the base frame 20 and the electrical connector 40 are overmoulded with PPA in an injection moulding process to form the support frame 50, with the base frame 20 and electrical connector 40 partially embedded in the support frame 50. The base frame 20, electrical connector 40 and support frame 50 together form the frame 10.

In an additional step (not shown), the electrically conductive pins 30 may be arranged on the base frame 20, in contact with the electrically conductive elements of the base frame 20, and laser welded to the base frame 20. This additional step may be performed directly after the first step of forming the base frame 20, directly before or after the eighth step of laser welding the electrical contacts of the electrical connector 40 to the base frame 20, or after the support frame 50 has been formed.

It will be appreciated that the frame of the present disclosure may be used in other types of aerosol-generating device, such as aerosol-generating devices adapted to vapourise a liquid aerosol-forming substrate. It will also be appreciated that other embodiments of frames in accordance with the present disclosure may have other forms and configurations and may be made from other materials. It will also be appreciated that other methods of manufacture may be used to form a frame in accordance with the present disclosure.

The invention claimed is:

1. A frame for an aerosol-generating device, the frame comprising:

a base frame formed from an electrically conductive material;

an electrical connector having a plurality of electrical contacts, the plurality of electrical contacts being arranged on a connector frame formed from an electrically insulating material, the electrical connector being secured to the base frame such that the base frame is electrically connected to at least one of the electrical contacts of the electrical connector; and a support frame formed from an electrically insulating material, wherein the base frame and electrical connector are at least partially embedded in the support frame.

2. The frame according to claim 1, wherein the electrical connector is secured to the base frame at the at least one of the electrical contacts.

3. The frame according to claim 1, wherein the support frame at least partially overlaps the electrical connection between the base frame and the at least one of the electrical contacts.

4. The frame according to claim 1, wherein the base frame is elongate, having a proximal end and a distal end opposite the proximal end, and wherein the electrical connector is secured to the base frame at the distal end.

5. A method of manufacturing a frame for an aerosol-generating device, the method comprising:

providing a base frame formed from an electrically conductive material;

providing an electrical connector having a plurality of electrical contacts, the plurality of electrical contacts being arranged on a connector frame formed from an electrically insulating material;

securing the base frame to the electrical connector, such that the base frame is electrically connected to at least one of the electrical contacts of the electrical connector; and at least partially embedding the base frame and the electrical connector in a support frame formed from an electrically insulating material.

6. The method of manufacturing a frame according to claim 5, wherein the base frame is secured to the electrical connector at the at least one of the electrical contacts.

7. The method of manufacturing a frame according to claim 5, wherein the base frame is secured to the electrical connector by laser welding.

8. The method of manufacturing a frame according to claim 5, wherein the support frame at least partially overlaps the electrical connection between the base frame and the at least one of the electrical contacts.

9. The method of manufacturing a frame according to claim 5, wherein the support frame is formed by overmoulding the electrically insulating material over the base frame and the electrical connector to at least partially embed the base frame and the electrical connector in the support frame.

10. The method of manufacturing a frame according to claim 5, wherein the step of providing the electrical connector comprises:

providing a plurality of electrical contacts; and at least partially embedding the plurality of electrical contacts in a connector frame formed from an electrically insulating material to form an electrical connector.

11. The method of manufacturing a frame according to claim 5, wherein the base frame is electrically connected to each of the electrical contacts of the electrical connector.

12. A frame for an aerosol-generating device manufactured by the method according to claim 5.

13. An aerosol-generating device comprising a frame according to claim 1.

* * * * *